US006226463B1

(12) United States Patent
Phillips et al.

(10) Patent No.: US 6,226,463 B1
(45) Date of Patent: May 1, 2001

(54) AUTOMATIC CONSUMABLE CONDITIONING

(75) Inventors: Quintin T. Phillips; Joseph L. Burquist; Mary B. Baumunk, all of Boise, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/394,442

(22) Filed: Sep. 9, 1999

(51) Int. Cl.[7] ..... G03G 15/00; G03G 21/00
(52) U.S. Cl. ..... 399/24
(58) Field of Search ..... 399/13, 14, 15, 399/24, 25, 26, 27, 29, 49, 61, 77

(56) References Cited

U.S. PATENT DOCUMENTS 5,150,135 * 9/1992 Casey et al. ..... 347/125
5,710,956 * 1/1998 Kurohata et al. ..... 399/24
5,930,553 * 7/1999 Hirst et al. ..... 399/24 X
5,950,038 * 9/1999 Okui ..... 399/25 X

* cited by examiner

*Primary Examiner*—Sophia S. Chen
(74) *Attorney, Agent, or Firm*—Anthony J Baca

(57) ABSTRACT

New consumables installed in printing devices sometimes must print several pages to "condition" the consumable before use. This "conditioning" is required to allow various components to reach optimal condition for printing. The present invention seeks to ameliorate the situation of changes in a consumable affecting the print quality by modifying the printing behavior based on measurements made on the consumable or on the history of the consumable which is installed. If necessary, the new consumable is pre-conditioned before additional page are printed. Pre-conditioning is accomplished by printing either several test pages or by developing several images and subsequently cleaning these images into the waste toner hopper.

14 Claims, 3 Drawing Sheets

AUTOMATIC CONSUMABLE CONDITIONING

TECHNICAL FIELD

The present invention is in the field of printing and more particular dress print quality issues associated to changing a consumable.

BACKGROUND OF THE INVENTION

Electrophotographic processes for producing a permanent image on media are well known and commonly used. In general, these processes all include devices for: (1) charging a photoreceptor which is a drum or continuous belt bearing a photoconductive material; (2) producing an electrostatic latent image by exposing the charged area to a light image or a light emitting diode array, or scanning the charged area with a laser beam; (3) presenting particles of toner to the photoreceptor surface upon which the electrostatic latent image has been formed so that the particles are transferred to the electrostatic latent image; (4) transferring the particles from the photoreceptor to the media while maintaining the shape of the image formed on the photoreceptor drum; (5) fusing or fixing the particles in the shape of the image to the media; and (6) cleaning or restoring the photoreceptor for the next printing cycle.

Referring to FIG.1, the electrophotographic printer 300 of the prior art has therein feed rollers 321 and 322 for feeding the printing sheets stacked in the printing sheet cassettes 311 and 312, a pair of rollers 323 for conveying a printing sheet fed from the printing sheet cassettes 311 or 312, an exposure array 376 for emitting light to the photosensitive drum 52 for forming an electrostatic latent image on the photosensitive drum 52, a transfer electrostatic charger 327 for transferring toner from the photoconductive drum 52 to the printing sheet, a pair of heat rollers 328 for fixing the toner transferred on the printing sheet and a prior art electrophotographic cartridge 50.

The electrophotographic cartridge 50 has an electrostatic charger 84 for electrostatically charging the photoconductive drum 52 uniformly, a developer assembly 54 for applying toner to the electrostatic latent image formed on the photoconductive drum 52 after exposure to the exposure device 376, and a cleaner 76 for removing the untransferred toner which remains on the photoconductive drum 52 after the transfer step. The untransferred toner is stored in waste hopper 85. Electrostatic charger 84 may be a charge roller assembly or a corona assembly. Further information about alternative photographic processes is available in the text "The Physics and Technology of Xerographic Processes", by Edgar M. Williams, 1984, a Wiley-Interscience Publication of John Wiley & Sons, the disclosure of which is hereby incorporated by reference.

Many image forming apparatus utilize the electrophotographic printing process, examples being laser printers, copy machines, and facsimile machines. As described above, these image forming apparatus use toner to print or copy the desired image or words onto a piece of paper or media. The toner is contained in a reservoir which is depleted as a result of printing. For example, the toner in a laser printer is generally depleted after printing from 2,000 to 30,000 pages depending upon the initial supply of toner in the reservoir and the coverage of the text or graphics images printed.

Monochrome Electrophotographic printers are typically designed so that the components involved in actually accomplishing electrophotographic printing are contained in a disposable electrophotographic print cartridge. The disposable toner cartridge, is conventionally identified as a "consumable" or "consumable product" because of its limited "life" (i.e., the toner will eventually deplete or some other component will eventually wear out). The components usually included in the disposable cartridge are the photoconductor drum, the drum charging assembly, such as the charge roller assembly or the corona assembly, the developer assembly, the drum cleaning blade, and the supply of toner used for forming the print text or print images. These items and other similar components are also commonly identified as consumables because they too have a limited life. The supply of toner is contained in a toner reservoir. The useable life of the cartridge is limited by the available supply of toner in the toner reservoir and the useable life of the cartridge components, particularly the photoconductor, the developer assembly, and the drum charging assembly. Upon exhaustion of the toner supply in the cartridge, it is necessary to replace the empty cartridge with one having the reservoir filled with toner.

Color Electrophotographic printers generally do not have a single toner cartridge. However, the consumables still need to be replaced as they are depleted. Some color electrophotographic printers allow the user to replace each individual color of toner independent of changing the photoconductor drum or belt.

New consumables installed in electrophotographic printing devices often must print several pages (up to 25 pages) to "condition" the consumable before use. This "conditioning" is required to allow various components to reach optimal condition for printing. Functions such as the distribution of lubrication from the cleaning blade on the photoconductor, pre-stirring of the toner, conditioning of the developer sleeve, etc. are performed during this "conditioning" time.

This approach is especially troublesome for printer users who have had a printing job interrupted due to a consumable issue, such as running out of toner. Prior to the present invention, if a printing job is interrupted due to a consumable issue, installation of the new consumable will result in the immediate continuation of the printing job. The first several pages (up to 20) may have print quality defects and thus affect the entire print job adversely. As an example, a customer may be printing an instruction manual which is several hundred pages in length. During the printing one of the consumables is exhausted stopping the printing process. The user installs a new consumable the printer begins printing again. If a "conditioning" problem exists, up to 20 pages could have print quality defects. These pages would be in the middle of the printed material and would degrade the print quality of the entire job. Most manufacturers do not provide warranty coverage of consumables from page 1, but rather specify a few pages of unwarranted printing at the beginning of consumable life.

SUMMARY OF THE INVENTION

In order to accomplish the present invention, there is provided a printing apparatus. The printing apparatus has a print engine, which uses a consumable. There is a memory connected to the print engine and a processor connected to the print engine and the memory. The processor detects a replacement of the consumable, if said replacement consumable is new, the processor instructs the print engine to condition the consumable.

There is also provided a method for controlling an imaging device. Anytime a consumable is replaced in the imaging device, the status of the consumable is determined. The consumable is conditioned if the status indicates that the consumable is new.

There is describe several methods for determining if the consumable needs conditioning.

BRIEF DESCRIPTION OF THE DRAWINGS

A better understanding of the invention may be had from the consideration of the following detailed description taken in conjunction with the accompanying drawings in which.

DETAILED DESCRIPTION OF THE PREFERRED EMBODIMENTS

Figure 2:
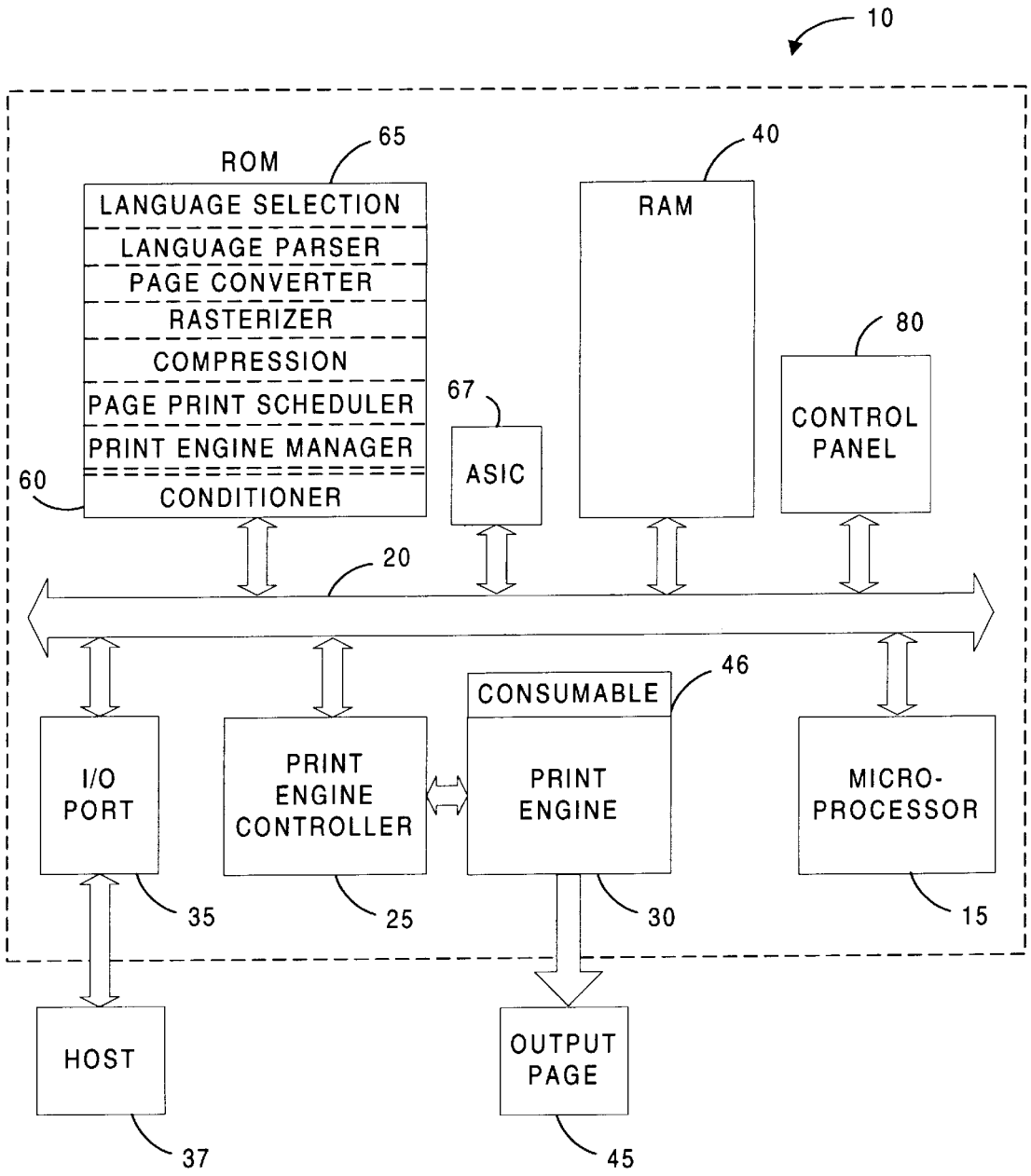
FIG. 2 is a block diagram of a laser printer embodying the present invention self-resizing demonstration page image.

The present invention is not limited to a specific embodiment illustrated herein. The present invention seeks to ameliorate the situation of changes in a consumable effecting the print quality by modifying the printing behavior based on measurements made on the consumable or on the history of the consumable which is installed. FIG. 2 is a high level block diagram of a page printer 10 incorporating the present invention. Page printer 10 is controlled by a microprocessor 15 which communicates with other elements of the system via bus 20. A print engine controller 25 and associated print engine 30 connect to bus 20 and provide the print output capability for the page printer. Output page 45 is printed from print engine 30. Print engine 30 uses various consumables 46 such as toner (or ink) and paper to create output page 45. When a consumable 46 is depleted or changed, the print engine indicates the condition to print engine controller 25. Print engine 30 is preferably a laser printer that employs an electrophotographic drum imaging system as well known in the art. However, as will be obvious to those of ordinary skill in the art, the present invention is similarly applicable to other types of printers and/or imaging devices such as copiers, facsimile devices, ink jet printers and the like.

An input/output (I/O) port 35 provides communications between page printer 10 and host computer 37, and receives page descriptions from the host for processing within page printer 10. A dynamic random access memory (RAM) 40 provides a main memory for the page printer. For purposes of discussion herein, RAM 40 is representative of a general purpose memory and/or a cache memory associated with processor 15, both as well known in the art. During a print job, RAM 40 stores image data prior to being output by print engine 30.

A read-only memory (ROM) 65 holds firmware which controls the operation of microprocessor 15 and page printer 10. Although the firmware routines are discussed in reference to being stored in ROM 65, it is understood that their functionality may likewise be implemented in ASIC 67 if so desired. The routines (code procedures) stored in ROM 65 may include the following: a language selection routine, language parser routine, page converter, rasterizer, compression code, page print scheduler, and print engine manager. The language selection routine determines and identifies which printer description language (i.e., printer job language, printer control language, or page description language), such as PJL, PCL, PostScript, etc., is being processed for any given print job. The language parser parses the identified printer language to enable the particular job at hand to be executed (or interpreted) and printed. The page converter firmware converts a page description received from the host to a display command list wherein each display command defines an object to be printed on the page. The rasterizer firmware converts the display commands to appropriate bit maps, divides a page into logical bands (or strips), and distributes the bit maps (or rasterized bands/strips) into memory 40. The compression firmware compresses the rasterized bands or other data as necessary. Each of these routines may be conventional in the art.

Importantly, ROM 65 further includes conditioning routines 60 according to the present invention. Conditioning routines are used by printer 10 to control when and how a particular consumable is to be conditioned.

It should be noted here that although conditioning routine 60 is shown as being stored in ROM 65, under principles of the present invention it is similarly feasible for it to be stored in other types of storage devices, such as a flash memory module or on memory devices located on the consumable.

In further reference to the operation of printer 10, when a page is ready for processing (i.e., all bands or strips of the page have been evaluated, rasterized, compressed, etc. for processing by print engine 30) then the rasterized bands are stored in turn to certain pre-allocated video buffers (not shown). Subsequently, the bands are passed to print engine 30 by print engine controller 25 to enable the generation of an image (i.e., text/graphics etc). The page print scheduler controls the sequencing and transferring of bands to print engine controller 25. The print engine manager controls the operation of print engine controller 25 and, in turn, print engine 30. If print engine 30 detects that a consumable 45 is depleted, the printing stops and print engine controller 25 is notified of the depleted consumable. Once the depleted consumable is replenished, or replace, print engine 30 so informs print engine controller 25. Print engine controller 25 indicates to microprocessor 15 that the depleted consumable has been replenished or replaced. Depending on the type and condition of the consumable, microprocessor 15 may invoke conditioning routine 60 to pre-condition the new consumable. Additionally, if any consumable is replaced, print engine 30 notifies print engine controller 25 of the type of consumable changed and the status of the newly inserted consumable. As above, Print engine controller 25 indicates to microprocessor 15 that the consumable has been changed. Depending on the type and condition of the consumable microprocessor 15 may invoke conditioning routine 60 to pre-condition the new consumable.

Figure 3:
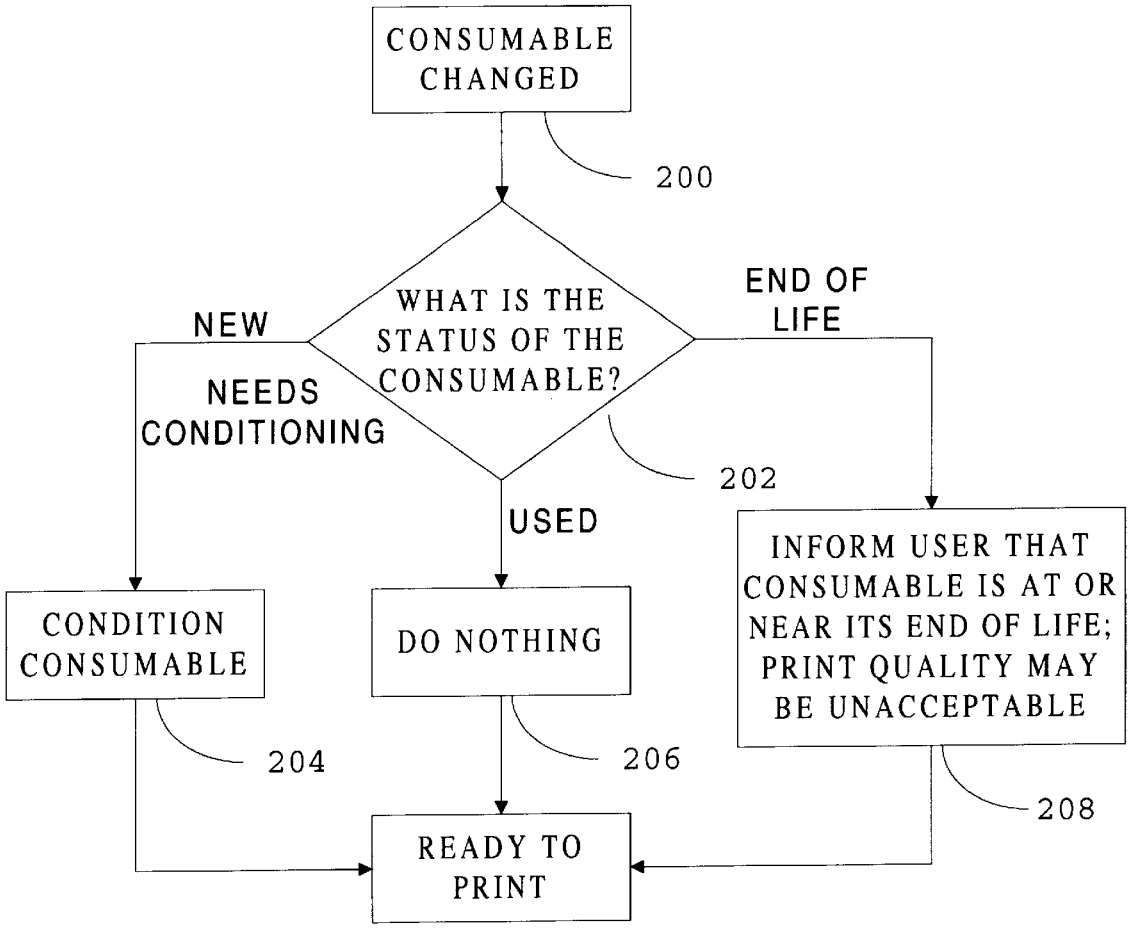
FIG. 3 is a flow chart of showing the logical flow of the preferred embodiment.

Referring now to FIG. 3, there is shown a flow chart of the preferred embodiment. As the printer operates, it monitors for a change in any consumable (200). Once a consumable change is detected, the status of the consumable is determined (202). If the changed consumable does not require conditioning, then nothing is done (206). Such action may be the result of the determination that the type of consumable, such as media, changed does not require conditioning, or a determination that the consumable has already undergone a conditioning cycle, that is, the consumable is used. If the consumable is at or near its end of life, the user is so notified (208). Alternatively, the consumable is conditioned if so required (204).

Figure 1:
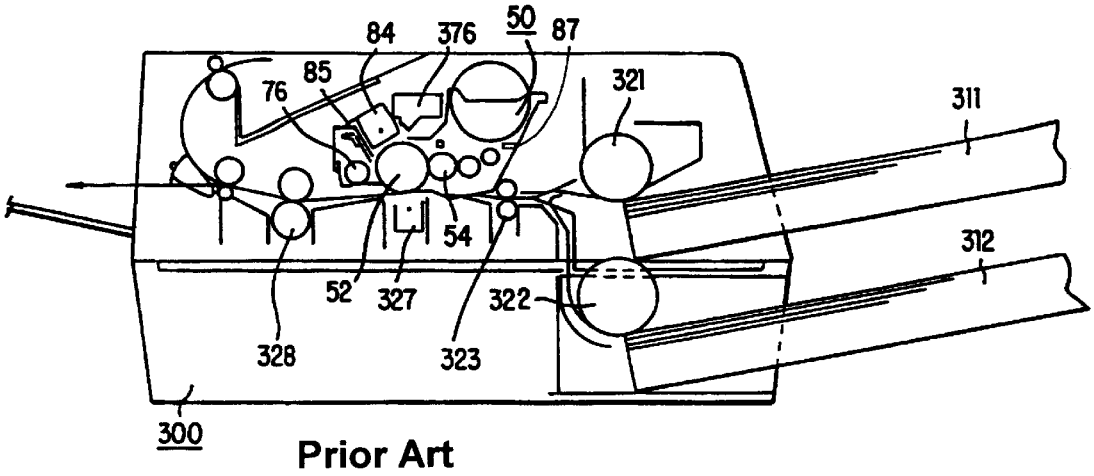
FIG. 1 is a schematic representation of an electrophotographic printer showing a prior art electrophotographic cartridge installed in the printer.

The status of the consumable (202), including the type may be accomplished by any of several methods. For example, a characteristic of the consumable may be measured, or a indicator for indicating whether the consumable is new could be read, or a memory device (87 in FIG. 1) on the consumable can be interrogated. If measurements of a characteristic is made, the measurements of the consumable condition could be accomplished by reading the condition of the consumable such as the toner level or the thickness of the photoconductor. If an indicator is used, the printer would change the indicator to "used" once the consumable has been conditioned. Alternatively, determination of the consumable condition by reading memory device such as an electronic memory chip or magnetic recording strip which is used to store a history of consumable use could be used. In this implementation the use history of the consumable would be stored on the memory device and any use of the consumable would be recorded.

If a consumable, or new component, which needs conditioning is discovered, the system is conditioned by printing either several test pages or by developing several images and subsequently cleaning these images into the waste toner hopper. The purpose is to simulate the printing condition as far as possible to "condition" the newly replaced component before using it in an application which will require optimal printing performance from the component. The exact number of pages or images, is dependent on the printer system and the component changed.

Although the preferred embodiment of the invention has been illustrated, and that form described, it is readily apparent to those skilled in the art that various modifications may be made therein without departing from the spirit of the invention or from the scope of the appended claims.

What is claimed is:

1. A printing apparatus comprising:

a print engine;

a consumable attached to the print engine;

a memory connected to the print engine; and a processor connected to the print engine, the processor detecting a replacement of the consumable with a second consumable, if said second consumable needs conditioning, instructing the print engine to condition the consumable.

2. The printing apparatus as claimed in claim 1 further comprising;

a print engine controller connected to the print engine.

3. The printing apparatus as claimed in claim 1 wherein the processor instructing the print engine to print a predefined number of images to condition the second consumable.

4. The printing apparatus as claimed in claim 3 wherein the processor instructing the print engine to enter a print ready state when the second consumable is conditioned.

5. The printing apparatus as claimed in claim 1 wherein the second consumable further comprising a memory device positioned to communicate with the processor when the second consumable is installed, the processor communicating with the second consumable to detect if the replacement consumable needs conditioning.

6. A printing apparatus comprising:

a print engine;

a consumable attached to the print engine;

a memory connected to the print engine;

a processor connected to the print engine, the processor detecting a replacement of the consumable with a second consumable wherein the second consumable further comprising a memory device positioned to communicate with the processor;

if said second consumable needs conditioning, instructing the print engine to condition the consumable, and processor communicating to the memory device on the second consumable that the second consumable is conditioned after the print engine indicates to the processor that the second consumable is conditioned.

7. A method for controlling an imaging device, said method comprising the steps of:

detecting replacement of a consumable in the imaging device;

determining a status of the consumable;

conditioning the consumable if the status indicates that the consumable needs conditioning; and entering a state of print ready when consumable is conditioned.

8. The method of claim 7 wherein the step of determining further comprising the step of:

measuring a characteristic of the consumable and comparing it to a known value indicative of the status of the consumable.

9. The method of claim 7 wherein the step of determining further comprising the step of:

reading a memory device on the consumable.

10. A method for controlling an imaging device, said method comprising the steps of:

detecting replacement of a consumable in the imaging device;

reading a memory device on the consumable;

determining a status of the consumable;

conditioning the consumable if the status indicates that the consumable needs conditioning;

entering a state of print ready when consumable is conditioned; and after consumable is conditioned, writing to the memory device to indicate that consumable is conditioned.

11. An imaging device comprising:

a removable consumable;

means for using the removable consumable to create an image;

means for sensing if the removable consumable needs conditioning by measuring a characteristic of the removable consumable; and means for conditioning the removable consumable.

12. The imaging device as claimed in claim 11 wherein the removable consumable further comprising a memory device.

13. The imaging device as claimed in claim 12 wherein the means for sensing further comprising means for interrogating the memory device to determine if the consumable needs conditioning.

14. An imaging device comprising:

a removable consumable;

means for using the removable consumable to create an image;

means for sensing if the removable consumable needs conditioning;

means for conditioning the removable consumable; and means for indicating that the removable consumable is conditioned.

* * * * *